US005185057A

United States Patent [19]

Playdon

[11] Patent Number: 5,185,057

[45] Date of Patent: Feb. 9, 1993

[54] METAL ETCHING PROCESS AND COMPOSITION

[75] Inventor: Terence S. Playdon, Transvaal, South Africa

[73] Assignee: Jutland Development CC, Transvaal, South Africa

[21] Appl. No.: 669,431

[22] Filed: Mar. 15, 1991

[30] Foreign Application Priority Data

Mar. 15, 1990 [ZA] South Africa ..... 90/1988

[51] Int. Cl.[5] ..... B44C 1/22; C23F 1/00

[52] U.S. Cl. ..... 156/642; 156/664; 156/665; 156/666; 252/79.2; 252/79.4; 427/309

[58] Field of Search ..... 252/79.2, 79.4; 134/3, 134/41; 156/642, 651, 656, 659.1, 664, 665, 666; 427/309

[56] References Cited

U.S. PATENT DOCUMENTS

| | | | |
|---|---|---|---|
| 2,886,420 | 5/1959 | Jones et al. | 156/642 |
| 3,115,419 | 12/1963 | Dale | 156/665 X |
| 3,761,331 | 9/1973 | McClanahan | 156/665 X |

FOREIGN PATENT DOCUMENTS

| | | |
|---|---|---|
| 1527104 | 4/1968 | France . |
| 49-102535 | 9/1974 | Japan . |
| 60-19529 | 1/1985 | Japan . |
| 885059 | 8/1987 | South Africa . |

OTHER PUBLICATIONS

Abstract No. 27337 "Microetch Solution of Aluminum" 2244 Research Disclosure No. 273, Jan. 1987, p. 28.

Excerpts from "The Surface Treatment and Finishing of Aluminum and its Alloys", S. Wrnick and R. Pinner, 5th Ed.

*Primary Examiner*—William A. Powell

*Attorney, Agent, or Firm*—Cushman, Darby & Cushman

[57] ABSTRACT

The invention provides a process for etching a metal surface by applying, to the metal surface, a solution of ferric chloride at an effective concentration, which solution also contains phosphoric acid. The etching is done in an etching tank and the effective concentration of ferric ions is maintained by diffusing an oxidizing agent which is chlorine gas or a compound which forms HOCl in solution through the tank. A number of other steps which may vary according to the type and grade of metal surface which is to be etched are also performed in terms of the process of the invention, both before and after the application of the etching solution to the metal surface. Metal surfaces etched according to the invention have a coating, for example polytetrafluoroethylene, subsequently applied thereto.

21 Claims, 1 Drawing Sheet

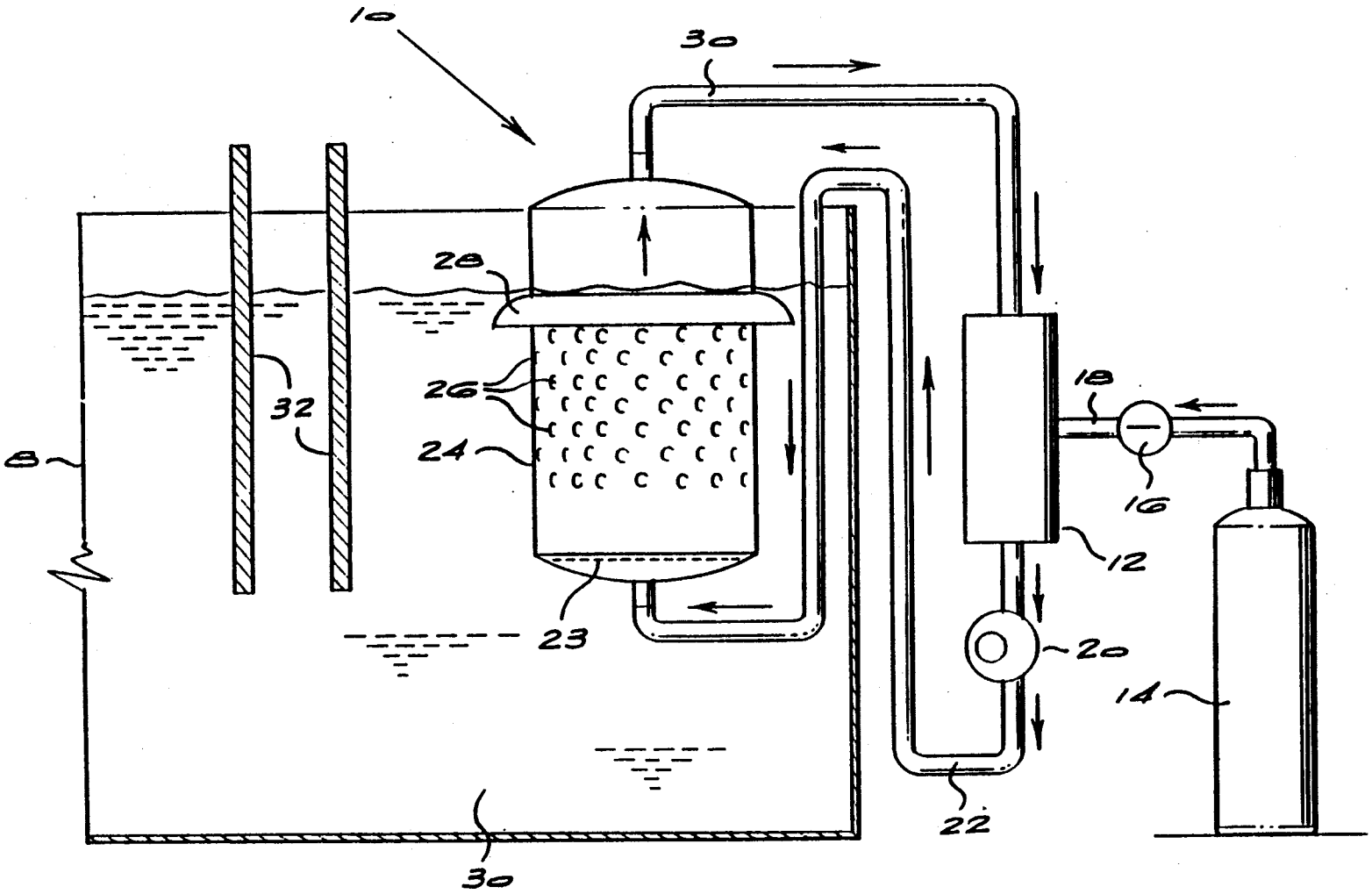
10
12
14
16
18
20
22
23
24
26
28
30
30
32
8

METAL ETCHING PROCESS AND COMPOSITION

BACKGROUND TO THE INVENTION

This invention relates to an etching process.

Existing methods of etching metal surfaces to prepare them for the adhesion thereto of some form of coating include the physical roughening of the surface by grit blasting, wheel sanding, wire brushing and directional grinding. These existing methods have various disadvantages associated with them. Gritblasting is a slow and expensive process, while the other processes have to be carefully controlled as severe roughening of the surfaces must be avoided.

The use of ferric chloride, applied as a solution to a metal surface, to roughen the surface has also been proposed. It has however been discovered that the action of ferric chloride is very dependant upon the type of degreasing that is carried out and also that certain metals, including die-cast aluminium, are not etched by the application of ferric chloride to them. The process also does not provide the flexibility required to vary the etch depth and the etch profile.

A further problem hitherto associated with the use of ferric chloride as an etching agent, is that the ferric ions in solution, an integral component of the etching process, become reduced during the etching process to ferrous ions and then finally to iron with a simultaneous reduction in the etching power of the solution. The precipitation of iron from the etching solution indicates the total depletion of ferric chloride in the solution and the end of its use as an etching agent. At this stage, the solution must be discarded as waste. However, the pollutants in this solution make its disposal an expensive and hazardous exercise.

SUMMARY OF THE INVENTION

According to the invention there is provided a process for etching a metal surface including the step of applying, to the metal surface, a solution of ferric chloride at an effective concentration, the solution containing a phosphorus acid.

"Effective concentration" means that the concentration of ferric chloride is sufficient to etch the metal.

The percentages, by volume, of the ferric chloride and the phosphorus acid in the solution are preferably from about 10 to about 20% and from about 1 to about 2%, respectively.

The solution may also contain a wetting agent which may be a surfactant.

The process may also include the step of adding, to the solution, an oxidizing agent capable of maintaining the ferric chloride at substantially the effective concentration. The oxidizing agent will be capable of oxidising ferrous ions in the solution to ferric ions.

The oxidizing agent is preferably chlorine gas ($Cl_2$) or a compound which forms HOCl, in solution.

The process is preferably carried out in an etching tank containing the solution, the metal surface being placed into the tank.

A diffuser, through which the oxidizing agent can diffuse into the solution, is preferably at least partially submerged in the tank.

The process may include the step of degreasing the metal surface, prior to the application of the solution thereto, by applying a degreaser.

The degreaser is preferably 1,1,1-trichloroethane.

The process may also include the step of applying a first desmutting agent to the metal surface before the application of the solution thereto.

A second combined desmutting and etching agent may also be applied to the metal surface after the application of the solution thereto.

The first desmutting agent is preferably a deoxidiser and the second combined desmutting and etching agent is preferably an alkaline solution, for example caustic soda.

The process may also include the steps of rinsing the metal surface, preferably with water, after the application of the degreaser, after the application of the first desmutting agent, after the application of the solution or after the application of the second combined desmutting and etching agent thereto or after the application of each of them.

After the application of the second combined desmutting and etching agent to the metal surface, the first desmutting agent may be applied to the surface again, and the metal surface subsequently rinsed.

The phosphorus acid is preferably phosphoric acid.

The metal is preferably rolled aluminium, extruded aluminium, die-cast aluminium, brass or copper.

According to yet another aspect of the invention a method of applying a coating to a metal surface includes the steps of applying a solution of ferric chloride containing a phosphorus acid to the surface and subsequently applying the coating thereto.

The method may also include the step of removing any deposits caused by the action of the solution on the surface, from the surface, before applying the coating thereto.

The coating may be a polymeric film, for example, polytetrafluoroethylene.

According to yet another aspect of the invention an etching agent comprises a solution of ferric chloride containing a phosphorus acid.

The solution preferably also contains a wetting agent, which may be a surfactant.

The phosphorus acid is preferably phosphoric acid.

BRIEF DESCRIPTION OF THE DRAWINGS

FIG. 1 is a schematic representation of an etch tank, containing an etching solution of the invention and with a diffuser submerged therein, for use in the process of the invention.

DETAILED DESCRIPTION OF THE INVENTION

The process of the invention involves the application of an etching solution comprising phosphoric acid and a surfactant which is compatible with phosphoric acid in a ferric chloride solution to a metal surface. A number of other steps which may vary according to the type and grade of metal surface which is to be etched are also performed in terms of the process both before and after the application of the etching solution of the invention to the metal surface.

The metal surface to be etched is always prepared, before the application of the etching solution thereto, by degreasing it with 1,1,1-trichloroethane vapour (sold as "CHLOROTHENE VG" by DOW CHEMICALS). This degreasing step is necessary as the etching solution will not act on a greasy surface.

The process also includes a number of rinsing steps in which the metal surface is rinsed in a water spray bath to remove any deposits on the surface produced by the action of either the etching solution of the invention or any desmutting solutions which are subsequently applied to the surface. The water used in the rinse is sprayed on to the surface under pressure so that a large percentage of the smut on the metal surface is removed. This helps to limit the contamination by the smut of the desmutting solutions.

After the metal surface has been degreased and the etching solution of the invention has been applied to it, the surface is rinsed for the first time.

The rinsed metal surface is then subjected to the action of one or more desmutting agents. In certain applications two desmutting agents are used. In one embodiment, the first desmutting agent is a caustic soda solution, which also acts as an etchant, and the second combined desmutting and etching agent is a deoxidiser, commonly known as LNC. The metal surface is immersed in the first desmutting agent to aid the removal of deposits, in the form of a blackish smut, from the metal surface which are produced on the metal surface by the action of the etching solution of the invention and by the degreaser.

The metal surface, after having been removed from the caustic soda solution, is again rinsed in a water spray bath to remove any deposits on the surface as a result of action of the caustic soda solution. The second desmutting solution removes any deposits produced by the action of the caustic soda on the metal surface. The rinsed metal surfaces are immersed in a deoxidiser tank containing LNC and subsequently rinsed for a third time in a water spray bath.

When etching a grade of aluminium, known as 3004, the procedure as set out above is followed. However, as mentioned above, procedures may vary according to the type of metal surface which is being etched. In the case of a grade of aluminium known as 1200, an additional treatment of the metal surface with caustic soda before the application of the etching solution of the invention was found to produce a good, matt etch on the surface. The procedure for other grades of aluminium and for other types of metal may vary slightly from that outlined above, according to the type of etch required. For example, the metal surface may be subjected to the action of one desmutting agent, which may be a 10% solution of nitric acid, prior to immersion in the ferric chloride solution.

In an alternative embodiment, the metal surface is first rinsed after the degreaser has been applied to it. In this alternative embodiment, the first desmutter is the deoxidiser LNC, and the second desmutter is the caustic soda solution. The first desmutter is applied to the metal surface, which is then rinsed, before the etching solution is applied to it and again after the second combined desmutting and etching agent has been applied to it. Typical durations for each of the steps in this process are:

The first desmutting agent—5 minutes

Ferric chloride—3 minutes

The second combined desmutting and etching agent—2 minutes

The first desmutting agent—2 minutes.

This procedure gave a remarkably even edge with a Peak Count of 177 peaks per cm as opposed to an etch obtained with sandblasting which had about 100 peaks per cm, as measured by a Perthometer M4P. Aluminium of all grades and from different sources, including South African aluminium of grade 1200 was satisfactorily etched using this process. With this process, the etch depth and profile count can be varied considerably according to specifications. Latitude is also afforded in controlling the etch with this process. For example, by reducing the duration for which the metal surface is exposed to each of the reagents, an even, low profile etch is obtained.

Finally, the metal surfaces are immersed in a hot water rinse tank. The metal is rinsed twice to ensure total removal of all deposits on the metal surface and to assist in the drying of the metal surface. The metal surface is then removed from the rinse tank and allowed to dry.

The etching process of the invention, which includes the action of the etching solution of the invention, produces a clean, etched metal surface and is particularly effective when used on rolled, extruded or die-cast aluminium.

The actual etching process, i.e., the application of the etching solution to the metal surface, is performed in an etching tank. A diffuser assembly, as illustrated in FIG. 1, for diffusing chlorine gas ($Cl_2$) through the solution, is submerged in the tank. The chlorine gas which is diffused through the solution reacts with the water in the solution to form "chlorine water" or HOCL. HOCL is a powerful oxidizing agent that oxidizes the ferrous ions ($Fe^{2+}$), which have been produced as a result of the reduction of aluminium, to ferric ions ($Fe^{3+}$) according to the following reaction:

$$HOCl + H^+ + e^- = \tfrac{1}{2} Cl_2(g) + H_2O \qquad E^0_{red} = 1.63V$$

$$Fe^{2+} + = Fe^{3+} + e^- \qquad E^0_{ox} = -0.77V$$

$$HOCl + H^+ + Fe^{2+} = \tfrac{1}{2} Cl_2(g) + Fe^{3+} + H_2O \quad E_0{}^r = 0.86V$$

The chlorine gas generated by this reaction is also capable of oxidizing ferrous ions to ferric ions according to the following equation:

$$Cl^2(g) + 2e^- = 2Cl^- \qquad E^0_{red} = 1.36V$$

$$Fe^{2+} = [Fe^{3+} + e^-]^2 \qquad E^0_{ox} = -0.77V$$

$$Cl_2(g) + 2Fe^{2+} = 2Fe^{3+} + 2Cl^- \quad E_r{}^0 = 0.59V$$

From these equations it can be seen that the ferrous ions which are produced in the solution as a result of their reduction by aluminium, which is oxidised, are regenerated. In summary, the overall reaction may be characterised as follows:

$$Cl_2(g) + 2Fe^{2+} - 2Fe^{3+} + 2Cl$$

The metal blanks 32 which are to be etched are submerged in an etch tank 8 containing a solution of ferric chloride, phosphoric acid and a surfactant. The diffuser 10, illustrated in FIG. 1, allows for the continuous provision of chlorine gas to the etch tank 8. The diffuser assembly 10 comprises a chlorine reservoir 12, which is replenished continuously by a supply of chlorine gas from a tank 14. A regulator valve 16, in a supply pipe 18, responds to fluctuations in the levels in the chlorine reservoir either by opening and allowing the inflow of chlorine gas or by closing and preventing further inflow of chlorine gas. A pump 20 is situated in an inflow pipe 22 from the reservoir 12 to the diffuser tank 24. The pump 20 provides for a continuous supply of chlorine gas to the diffuser tank 24. A glass or plastic diffuser 23, which breaks up the $Cl_2$ into small bubbles, is situated within the diffuser tank 24. A number of holes 26 are defined in the diffuser tank 24 through which the chlorine gas will diffuse into the solution 30, according to the demand in the tank 8. A hood 28 extends outwardly from the sides of the diffuser tank 24 to trap any undissolved chlorine bubbles nearing the surface, so that they do not escape into the atmosphere. Excess chlorine gas which is not required in the tank 8 then passes through an outflow pipe 30 and back into the chlorine reservoir 12 to be recirculated through the diffuser tank 24.

By using this diffuser assembly 10, the solution in the tank 8 almost never has to be regenerated and the etching process can be substantially continuous. There is also no need to dispose of the etch solution containing its pollutants, as is the case with prior art processes. The whole process is thus relatively safe, less environmentally harmful and allows for a great saving in costs and time.

The chlorine demand of the tank can be measured by titrating a sample of the solution from the tank with a standard dichromate solution, using sodium diphenylamine sulphonate as a redox indicator.

The process of the invention will now be described in more detail with reference to the following examples.

EXAMPLE 1

Circular blanks of rolled aluminium (grade 3004) were degreased in a 1,1,1-trichloroethane vapour bath. The blanks, were then loaded onto purpose made jigs, at a distance of 20 mm from one another, and immersed in a solution of phosphoric acid and a surfactant in ferric chloride at room temperature for about 15 minutes. The solution contained about 5% by weight of phosphoric acid and about 5% by weight of the surfactant. The jig was then removed after this set period of time and the blanks were allowed to drain.

The jigs containing the blanks were then immersed in a water spray bath and water was sprayed, under pressure, onto the surface of each blank to rinse them thoroughly. The jig was then removed from the water spray bath and immersed in a caustic soda etch tank wherein the caustic soda water heater to a temperature of about 50° C. for about 5 minutes. The jig was then removed and the blanks were again allowed to drain. The jig was once again immersed in a water spray bath and the blanks were again all thoroughly rinsed with water. The jig was then removed from the water spray bath and immersed in a deoxidiser tank containing the deoxidiser LNC, which was heated to a temperature of about 50° C., for about 5 minutes. The jig was removed and the blanks were again allowed to drain. The jig was then once again immersed in a water spray bath. The jig was then subsequently immersed in a hot water rinse tank at approximately 60° C. for about 2 minutes. When the jig was removed the blanks were dried using an air hose. Each blank had a clean white etched surface.

EXAMPLE 2

A good etch was obtained on grade 1200 aluminium using the procedure of Example 1, at ambient temperature, and reagents in the following proportions:

| REAGENTS | WEIGHT |
|---|---|
| 70% ferric chloride ($FeCl_3$) | 180 |
| phosphoric acid (pure) (85%) | 20 |
| 10% of 30% HCL | 100 |

-continued

| REAGENTS | WEIGHT |
|---|---|
| water | 900 |
| | 1200. |

The caustic soda desmutter was used at a temperature of 50° C. and the deoxidizer, comprising chromic acid, phosphoric acid and water were used in the following proportions:

| REAGENTS | WEIGHT |
|---|---|
| chromic acid | 25 |
| phosphoric acid | 43.75 |
| water | 2100 |
| | 2168.75 |

In certain applications it is desirable that only one side of a blank be etched. In these cases, one side can be covered, for example, with a vacuum polyurethane cup to prevent etching of that particular surface.

Teflon or a similar coating may then be applied to the etched surface according to standard methods.

I claim:

1. A process for etching a metal surface including the step of applying, to the metal surface, a solution of ferric chloride at an effective concentration, the solution containing from about 1-2%, by volume, of a phosphorus acid.

2. A process according to claim 1 which also includes the step of adding, to the solution, an oxidizing agent capable of maintaining the ferric chloride at substantially the effective concentration.

3. A process according to claim 2 which is carried out in an etching tank containing the solution, the metal surface being placed into the tank.

4. A process according to claim 3 wherein a diffuser, through which the oxidizing agent can diffuse into the solution, is at least partially submerged in the tank.

5. A process according to claim 1 wherein the percentage, by volume of the ferric chloride in the solution is from about 10 to 20%.

6. A process according to claim 5 wherein the phosphorus acid is phosphoric acid.

7. A process according to claim 6 wherein the solution also contains a wetting agent.

8. A process according to claim 7 wherein the wetting agent is a surfactant.

9. A process according to claim 2 wherein the oxidizing agent is chlorine gas ($Cl_2$) or a compound which forms HOCl, in solution.

10. A process according to claim 1 which also includes the step of degreasing the metal surface, prior to the application of the solution thereto, by applying a degreaser.

11. A process according to claim 10 wherein the degreaser is 1,1,1-trichloroethane.

12. A process for etching a metal surface including the steps of applying to the metal surface, a solution of ferric chloride at an effective concentration, the solution containing a phosphorous acid; and applying a first desmutting agent to the metal surface, before the application of the solution thereto.

13. A process according to claim 12 wherein the first desmutting agent is a deoxidiser and the second combined desmutting and etching agent is an alkaline solution.

14. A process according to claim 12 which also includes the steps of rinsing the metal surface with water, after the application of the degreaser, after the application of the first desmutting agent, after the application of the solution or after the application of the second combined desmutting and etching agent thereto or after the application of each of them.

15. A process according to claim 14 wherein, after the application of the second combined desmutting and etching agent to the metal surface, the first desmutting agent may be applied to the surface again, and the metal surface subsequently rinsed.

16. A method of applying a coating to a metal surface including the steps of applying a solution of ferric chloride containing a phosphorus acid to the surface and subsequently applying the coating thereto.

17. A method according to claim 16 which also includes the step of removing any deposits, caused by the action of the solution on the surface, from the surface, before applying the coating thereto.

18. A method according to claim 16 wherein the coating is polytetrafluoroethylene.

19. An etching agent comprising a solution of ferric chloride containing from about 1–2%, by volume, of a phosphorus acid.

20. An etching agent according to claim 19 wherein the percentage, by volume, of the ferric chloride in the solution is from about 10 to about 20%.

21. A process according to claim 12 which also includes the step of applying a second, combined desmutting and etching agent to the metal surface after the application of the solution thereto.

* * * * *